US008567297B2

(12) United States Patent
Rose et al.

(10) Patent No.: US 8,567,297 B2
(45) Date of Patent: Oct. 29, 2013

(54) PENETRATOR AND METHOD OF MANUFACTURE SAME

(75) Inventors: David M. Rose, Kansas City, MO (US); W. Matthew Duffield, Jr., Kearney, MO (US); Edward C. Spanknoble, Gardner, KS (US); Michael Ledestich, Stillwell, KS (US)

(73) Assignee: ADF, LLC, Lenexa, KS (US)

( * ) Notice: Subject to any disclaimer, the term of this patent is extended or adjusted under 35 U.S.C. 154(b) by 92 days.

(21) Appl. No.: 13/221,668

(22) Filed: Aug. 30, 2011

(65) Prior Publication Data

US 2012/0067198 A1 Mar. 22, 2012

Related U.S. Application Data

(60) Provisional application No. 61/384,848, filed on Sep. 21, 2010.

(51) Int. Cl.
*B21K 21/06* (2006.01)

(52) U.S. Cl.
USPC ..... 86/51

(58) Field of Classification Search
None
See application file for complete search history.

(56) References Cited

U.S. PATENT DOCUMENTS

| | | | | |
|---|---|---|---|---|
| 446,739 | A | 2/1891 | Jones | |
| 1,149,485 | A | 8/1915 | Wilcox et al. | |
| 1,234,653 | A | 7/1917 | Gaynor | |
| 1,323,276 | A | 12/1919 | Hoagland | |
| 1,447,478 | A | 4/1923 | Koshollek et al. | |
| 1,769,263 | A * | 7/1930 | Johnson | 86/54 |
| 2,264,266 | A * | 11/1941 | Jacobs et al. | 148/650 |
| 2,318,505 | A | 5/1943 | Long | |
| 2,342,917 | A | 2/1944 | Brown | |
| 2,346,462 | A | 4/1944 | Southwell et al. | |
| 2,349,677 | A | 5/1944 | Reynolds | |
| 2,379,701 | A * | 7/1945 | Friedman | 86/54 |
| 2,393,155 | A | 1/1946 | Gaspar | |
| 2,394,842 | A * | 2/1946 | Catlin et al. | 72/352 |
| 2,573,634 | A * | 10/1951 | Whipple | 86/55 |
| 2,748,634 | A | 6/1956 | Koehrinq at at | |
| 3,594,882 | A * | 7/1971 | Lovell | 86/51 |
| 3,628,225 | A * | 12/1971 | Parker | 86/19.5 |
| 4,162,645 | A * | 7/1979 | Abbott | 86/23 |

(Continued)

OTHER PUBLICATIONS

Military Handbook; "Manufacture of Projectiles, Projectile Components, and Cartridge Cases for Artillery. Tank Main Armament, and Mortars"; Apr. 29 1991; Chapter 4.

(Continued)

*Primary Examiner* — Samir Abdosh
(74) *Attorney, Agent, or Firm* — Drinker, Biddle & Reath, LLP

(57) ABSTRACT

Penetrators and methods of manufacturing penetrators are disclosed. One method of manufacturing a penetrator having arrowhead geometry and base geometry includes the steps: (a) cold heading a piece of material to form a blank; (b) machining the blank to create the arrowhead geometry; and (c) roll forming the blank to create the base geometry. Another method of manufacturing a penetrator having arrowhead geometry and base geometry includes the steps: (a) machining a piece of material to create the arrowhead geometry; and (b) roll forming the piece of material to create the base geometry. Yet another method of manufacturing a penetrator from a blank includes the steps: (a) machining the blank to create a first surface feature of the penetrator; and (b) roll forming the blank to create a second surface feature of the penetrator.

4 Claims, 7 Drawing Sheets

(56) References Cited

U.S. PATENT DOCUMENTS

| | | | | |
|---|---|---|---|---|
| 4,254,958 | A * | 3/1981 | Bateman, III | 473/583 |
| 4,352,225 | A * | 10/1982 | Schreiber | 86/55 |
| 4,441,237 | A | 4/1984 | Kim et al. | |
| 5,009,166 | A | 4/1991 | Bilsbury et al. | |
| 5,894,644 | A | 4/1999 | Mravic | |
| 6,192,561 | B1 * | 2/2001 | Bennett | 86/19.5 |
| 6,439,127 | B1 * | 8/2002 | Cherry | 102/519 |
| 7,069,834 | B2 * | 7/2006 | Beal | 86/55 |
| 7,243,588 | B2 * | 7/2007 | Beal | 86/55 |
| 7,418,904 | B2 | 9/2008 | Illesi | |
| 7,748,325 | B2 | 7/2010 | Marx | |
| 7,874,253 | B2 | 1/2011 | Marx | |
| 2006/0243154 | A1 | 11/2006 | Illesi | |
| 2007/0163459 | A1 | 7/2007 | MacDougall | |
| 2008/0216700 | A1 | 9/2008 | Martini Filho | |
| 2008/0314280 | A1 | 12/2008 | Martini Filho | |
| 2011/0203477 | A1 * | 8/2011 | Amick | 102/501 |

OTHER PUBLICATIONS

Machinery; Index to vol. XXIV; Sep. 1917-Aug. 1918; pp. 690-696; The Industrial Press, New York 1918.

* cited by examiner

PENETRATOR AND METHOD OF MANUFACTURE SAME

CROSS-REFERENCE TO RELATED APPLICATIONS

This application claims priority to U.S. Provisional Patent Application No. 61/384,848, filed Sep. 21, 2010, which is incorporated herein by reference in its entirety.

BACKGROUND

The invention relates generally to penetrators and methods of manufacturing penetrators. More specifically, the invention relates to penetrators suitable for high volume production and high volume manufacturing processes.

Previous methodologies used to create penetrators from metals other than lead have proven to be restrictively slow and unsuitable for high volume production. For example, one prior art manufacturing process machines penetrators from steel bar; a bar of material is fed through a single spindle machining center, and all attributes of the penetrator are machined. The finished penetrator is then parted off, leaving a small tail which is later removed in a secondary deburring process. The process is very stable and adjustable, and tooling usage is limited to cutting inserts for the toolbars. One drawback of this process is the surface footage limitation of cutting the material, which is necessary to maintain a desirable surface finish. The prior art process is time intensive and requires a large number of individual machines committed to production in order to meet practical quantity requirements.

SUMMARY

Penetrators and methods of manufacturing penetrators are disclosed. In one embodiment, a method of manufacturing a penetrator having arrowhead geometry and base geometry includes the steps: (a) cold heading a piece of material to form a blank; (b) machining the blank to create the arrowhead geometry; and (c) roll forming the blank to create the base geometry.

In another embodiment, a method of manufacturing a penetrator having arrowhead geometry and base geometry includes the steps: (a) machining a piece of material to create the arrowhead geometry; and (b) roll forming the piece of material to create the base geometry.

In still another embodiment, a method of manufacturing a plurality of penetrators from a material besides lead includes the steps: (a) providing a plurality of blanks to at least one turning center; (b) using the at least one turning center to turn a portion of the blanks to create arrowhead geometry in the blanks; and (c) roll forming the blanks to create base geometry in the blanks. The base geometry blends with the arrowhead geometry. When provided to a turning center, each blank has a generally cylindrical body portion and a nose portion extending angularly from the cylindrical body portion. Each turning center has a spindle, a clamping device, and a cutting tool.

In yet another embodiment, a method of manufacturing a penetrator from a blank includes the steps: (a) machining the blank to create a first surface feature of the penetrator; and (b) roll forming the blank to create a second surface feature of the penetrator.

In still yet another embodiment, dies are provided for use in manufacturing a steel penetrator having arrowhead geometry and base geometry from a piece of material. A first die has a surface profile with an area complementary to the base geometry, and a second die has a surface profile with an area complementary to the base geometry.

DESCRIPTION OF THE INVENTION

Figure 1:
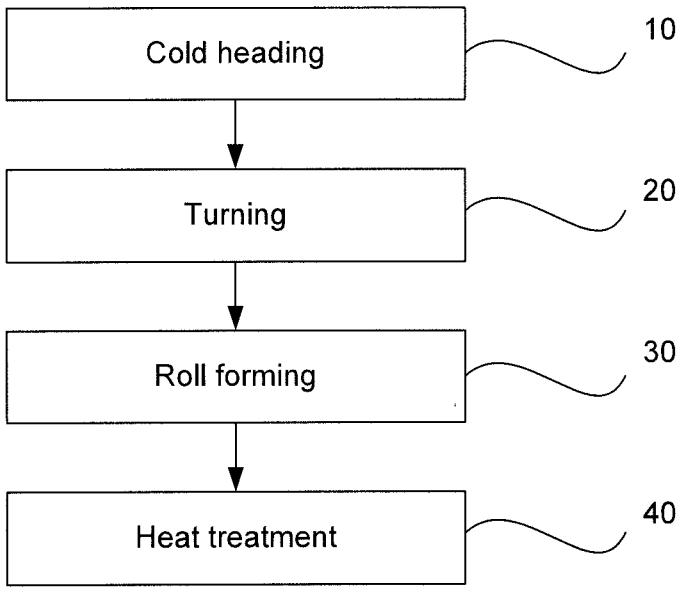
FIG. 1 shows a manufacturing method according to an embodiment.

The new manufacturing methods set forth below are a combination of cold heading (or "cold forming"), turning (or "machining"), and roll forming processes 10, 20, 30 (FIG. 1), and may result in reduced costs and increased production of penetrators. The cold heading process 10, discussed below in detail, is the first step. The turning step 20 is described below before the roll forming step 30; however, the order of the machining and roll forming steps 20, 30 may be altered at the discretion of the manufacturer. A fourth step, heat treatment 40, is also noted below and shown in FIG. 1. Additionally, those skilled in the art will appreciate that the ballistic shape of the penetrator is defined by the described processes, regardless of the penetrator's actual dimensions, and that any dimensions set forth below or in the drawings are only examples. "Penetrator" is used herein very broadly to refer both to ammunition that does not contain explosives as well as to other projectiles, including for example those that may contain an explosive load (e.g., in a cartridge) and those that may stay connected (e.g., by a cable) to launch equipment after being launched.

Attention is now directed to the cold heading process 10 with reference to FIGS. 2 through 6. Penetrator blanks 150 (FIGS. 5 and 6) are created by feeding a coil of raw material 100 into a single die cold heading machine 105. It should be appreciated that various cold head machines may be utilized. The machine 105 shown in FIGS. 2 through 5 cuts a length 101 of raw material 100 from the coil and forms a blank 150 in a single die 110. Specifically, steel raw material 100 (e.g., type A4140 or type C1055) is received as a coil. The coil's weight may be 250 pounds per coil or any other appropriate weight, and the raw material 100 may be drawn (or "extruded") to a desired diameter by pulling the material 100 through a carbide draw die.

Figure 2:
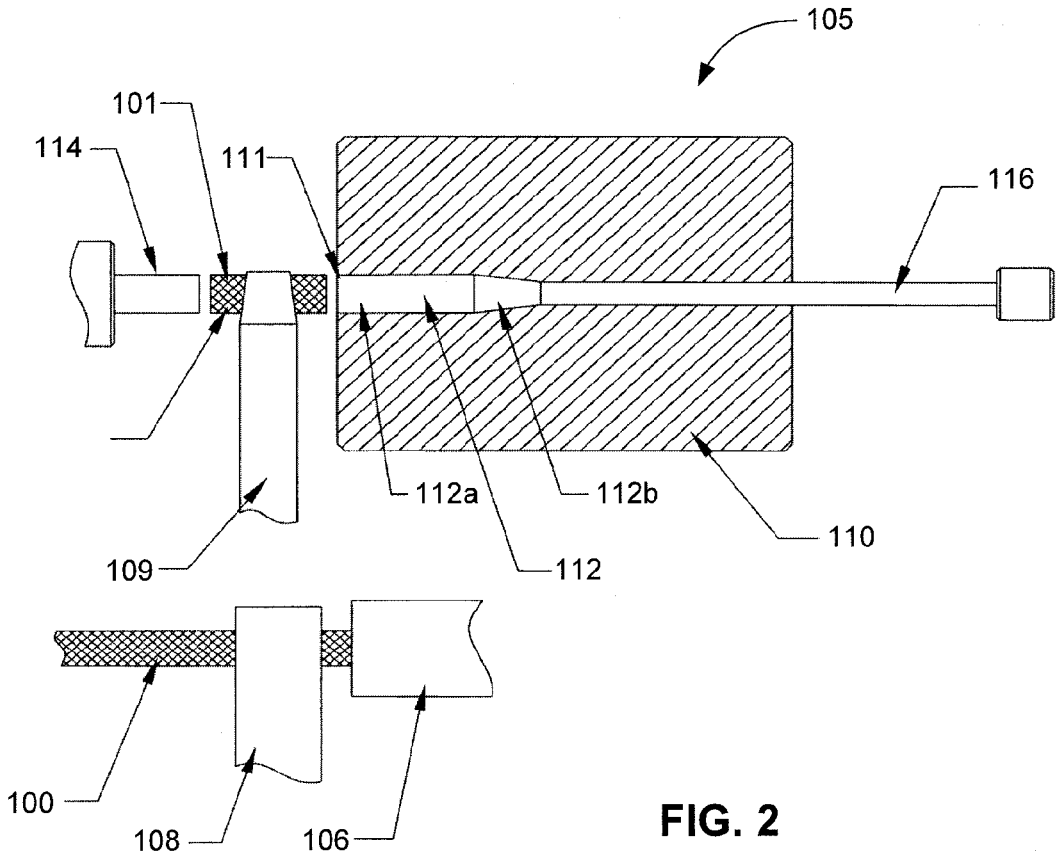
FIG. 2 shows a portion of a cold heading machine according to an embodiment, with the die shown in section and with a piece of raw material being transferred to the die.

As shown in FIG. 2, the extruded raw material 100 is moved (e.g., by feed rollers) into the cold heading machine 105 until an end of the material 100 contacts a stop 106. A cut off knife 108 then shears the length (or "segment") 101 of the material 100 from the remainder of the coil. Transfer fingers 109 grasp the sheared segment 101 and locate the segment 101 in front of the die 110.

The die 110 may for example consist of a carbide insert pressed into a hardened H-13 tool steel casing with a negative form of the headed blank 150 present in the carbide portion of the die. But those skilled in the art will appreciate that other types of dies may alternately be used. A diameter at a mouth 111 of the die 110 is sufficient to allow the cut off material segment 101 to fit into an exterior portion 112*a* of a cavity 112. An angular interior portion 112*b* of the cavity 112 may begin at a point far enough from the mouth 111 to allow the entire blank 150 to be formed inside the die 110.

Figure 3:
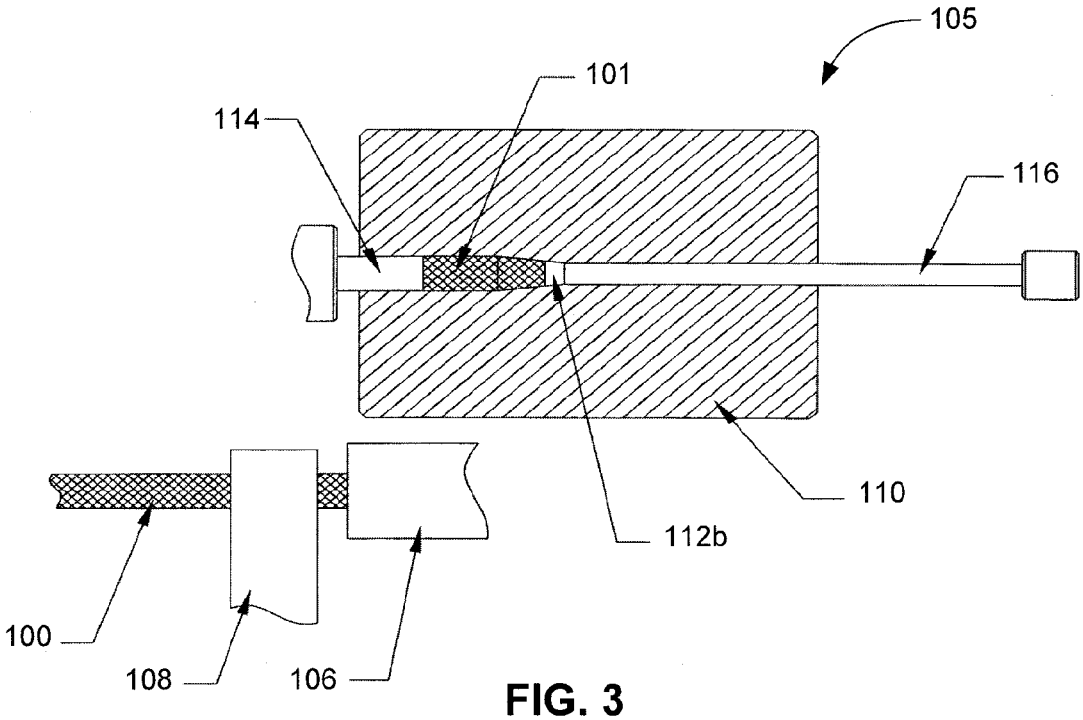
FIG. 3 shows the machine portion of FIG. 2 during a first blow operation.

A first blow, shown in FIG. 3, involves a pin 114 contacting the material segment 101 and pushing the segment 101 through the mouth 111 and into the cavity 112 of the die 110 a predetermined distance. The predetermined distance may be such that a portion of the segment 101 enters the angular interior portion 112*b* of the cavity 112. During this action, the transfer fingers 109 disengage the segment 101 and return to their original position for grasping a subsequent segment 101.

Figure 4:
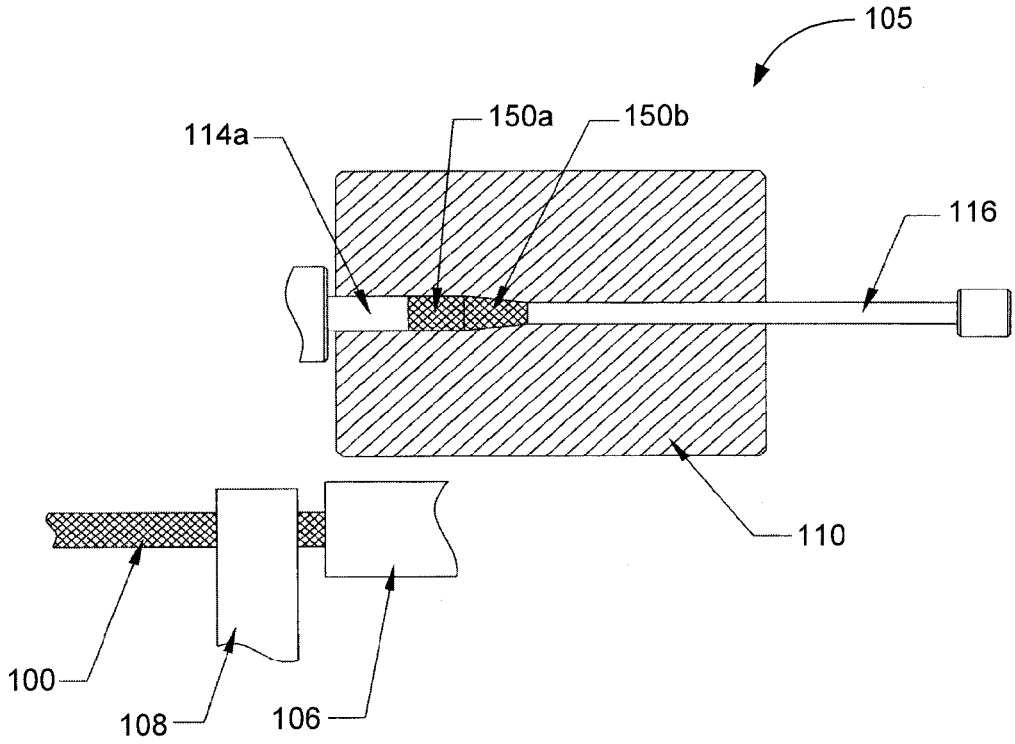
FIG. 4 shows the machine portion of FIG. 2 during a second blow operation.

A second blow, shown in FIG. 4, involves a second blow pin 114*a* (or instead the pin 114) forcing the material segment 101 fully into the die cavity 112 to form a cylindrical blank body 150*a* and an angled nose 150*b* of the blank 150. A knock-out pin 116 is located in stasis within the die 110 at an end of the cavity 112 opposite the mouth 111, and a face of the knock-out pin 116 stops the segment 101 during the cavity fill propagated by the second blow. Accordingly, the distance between the face of the blow pin 114*a* at its maximum inward travel position and the face of the knock-out pin 116 determines the length of the formed blank 150.

Figure 5:
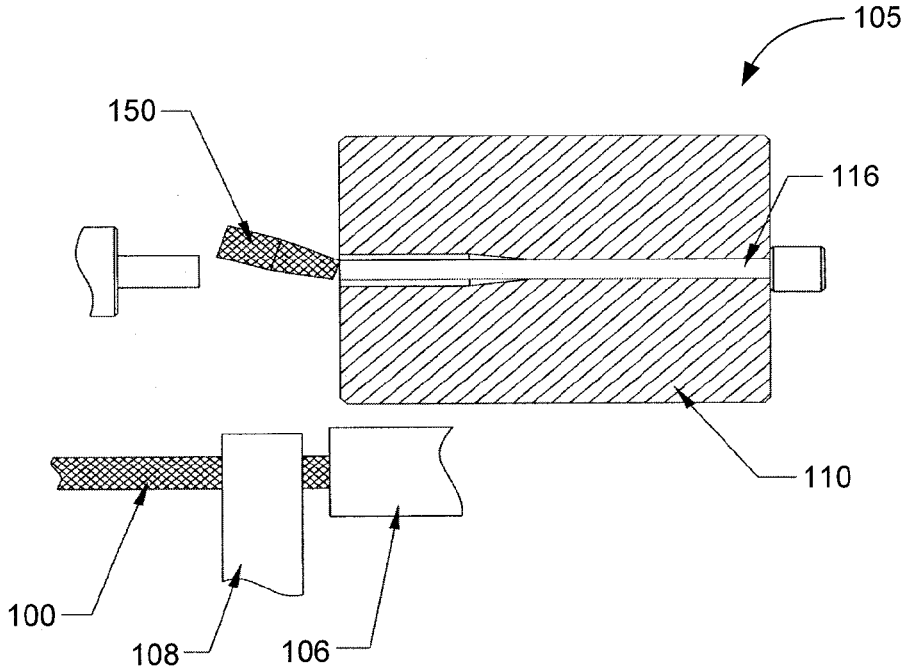
FIG. 5 shows the machine portion of FIG. 2 during a knock-out operation.
Figure 6:
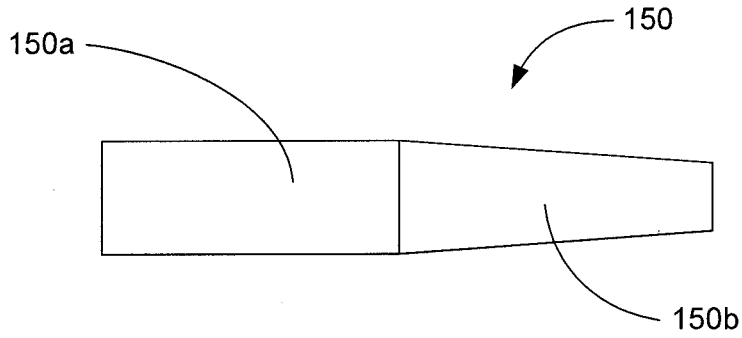
FIG. 6 shows an axial view of a cold headed blank according to an embodiment.

As the second blow pin 114*a* retracts from the die cavity 112, the knock-out pin 116 becomes active and forces the fully formed blank 150 out of the die 110 in a direction opposite to the forming event, as shown in FIG. 5. The formed blank 150 (FIG. 6) may then fall to an exit chute and roll into a pan for collection. The cold forming process 10 may be complete at this stage, yielding cycle times of, for example, two parts per second.

After the cold head operation 10, the blanks (or "slugs") 150 may be cleaned to remove residual oils and debris and sampled to ensure quality conformance. The blanks 150 may be cleaned in various manners, whether currently known in the art or later developed. For example, the blanks 150 may be washed in a soap and water mixture for ninety seconds, rinsed for thirty seconds, and dried for five minutes.

To ensure quality of the cold forming process 10, blanks 150 may be gathered and examined at specific or varying intervals. In one embodiment, three consecutive blanks 150 are inspected both visually and dimensionally to ensure quality. The visual inspection may examine, for example, uniformity of the blanks 150, the surface condition of the blanks 150, and the overall shape of the blanks 150. And the dimensional inspection may examine, for example, the overall length of the blanks 150, the diameter of the bodies 150*a*, the angle of the noses 150*b*, the length of the angled surfaces of the noses 150*b*, and the weight of the blanks 150. As the most critical attribute of the blanks 150 may be weight, it may be particularly desirable for the weight of the headed blanks 150 to be maintained at close tolerances. Nevertheless, it may also be particularly desirable to maintain the body diameter, the total length, and other attributes of the blanks 150 within predetermined tolerances. To maintain real time capability control, all quality control data may be entered into software.

The cleaned and validated formed blanks 150 may be batched together and placed into feeder bowls mounted on turning machines for use in the turning process 20. At the turning process 20, the blanks 150 satisfactorily formed in the cold forming process 10 may each have one end (i.e., angled nose 150*b*) turned. It may be desirable for the turning machines to be multi-station modular machining centers, with each station being capable of performing a complete machining process on respective formed blanks 150, so that multiple machined penetrators (or "turned blanks") 250 may be produced per cycle.

Figure 7:
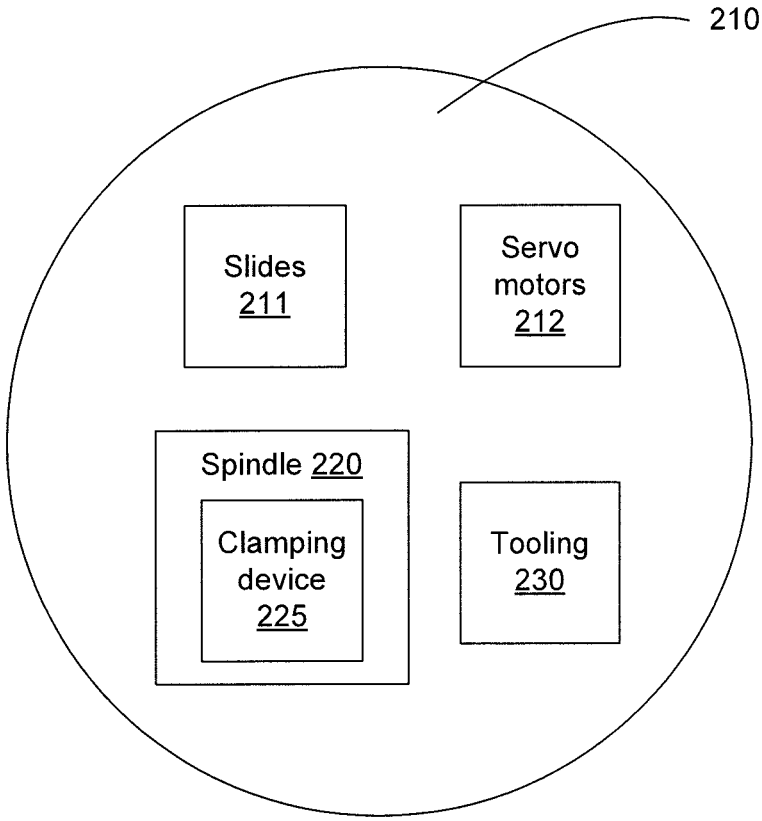
FIG. 7 shows a diagram of a turning center according to an embodiment.

The turning process 20 is a single point turning process, and one embodiment utilizes a plurality of turning machines (or "centers") 210 that are CNC-controlled and have two axes (X and Z). As shown in the diagram of FIG. 7, each machine 210 may include slides 211, servo motors 212, a spindle 220 having a clamping device 225, and tooling 230. To provide sufficient stability and minimal variability, the spindle 220 and the tooling 230 may be assembled into a rigid frame. As will be appreciated by those skilled in the art, various tooling 230 may be incorporated to cut the formed blanks 150.

Various clamping devices 225 may be used to hold the formed blanks 150 during the turning process 20. For example, variable speed, servo controlled spindles with clamp-style work holding devices may be used. Or any other appropriate holding device, whether currently known or later developed, may instead be utilized. One clamping device 225 may typically be required for each turning center 210.

In use, the formed blanks 150 may be fed into each clamping device 225 (e.g., via tubes attached to feed bowls), and the formed blanks 150 may be oriented such that the angled noses 150*b* face a predetermined direction (e.g., generally outwardly). To avoid damage to the turning centers 210 and the clamping devices 225, safeguards known in the art or later developed may be employed to automatically cease operation of a respective turning center 210 if a formed blank 150 is fed with incorrect orientation (e.g., facing generally downwardly).

Figure 9:
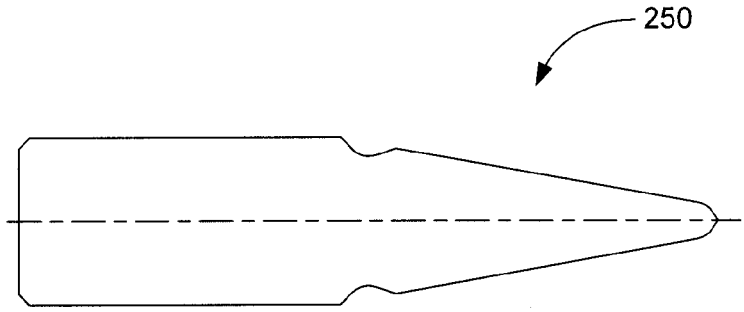
FIG. 9 shows an axial view of a cold headed and machined penetrator according to an embodiment.

With the formed blanks 150 correctly oriented and secured by the clamping devices 225 at the bodies 150*a*, arrowhead geometry is machined into each formed blank 150 using the turning centers 210. In one embodiment, each formed blank 150 is held in a stable location both horizontally and vertically while spinning (e.g., at approximately 8,000 rpms) with the spindle 220. Utilizing two axes of a respective machine 210 and the tool 230 mounted to it, the machined penetrators 250 may be created having the profile of an arrowhead by moving the cutting tool 230 simultaneously both vertically (X axis) and horizontally (Z axis) to achieve the desired geometry. The profile may be established using a set of mathematical formulas and geometric position points contained in software accessed by the machines 210, which may guarantee that same shape is always generated, regardless of tooling or other factors. After a respective machined penetrator 250 (FIG. 9) is created, it may be unclamped from the associated clamping device 225, ejected (e.g., using a burst of compressed air), and collected.

Figure 8:
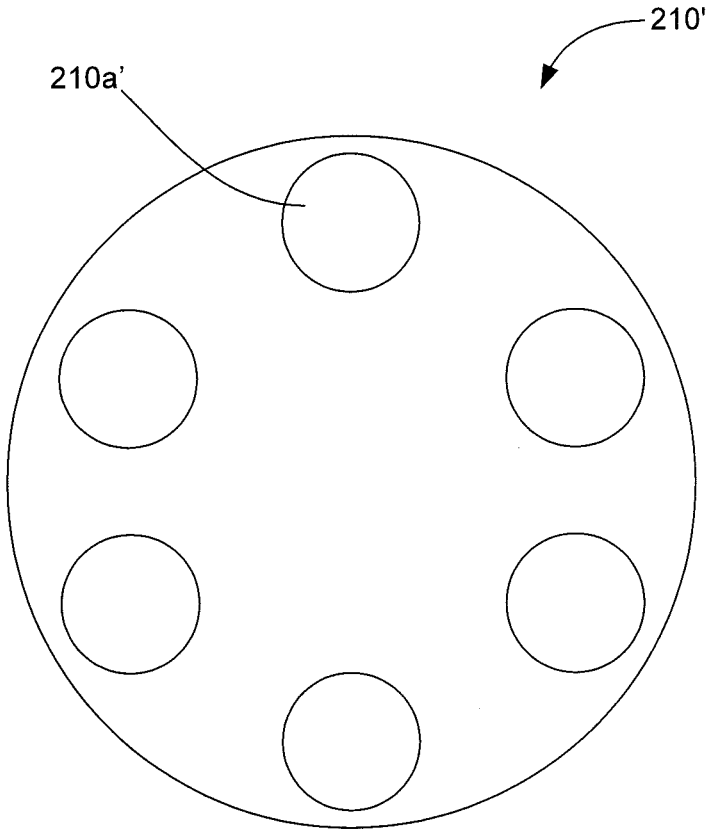
FIG. 8 shows a diagram of an alternative turning center, according to an embodiment.

While it may be desirable to use multiple turning centers 210 as described, other embodiments may employ a single turning center 210. Further, in some embodiments (as shown in FIG. 8), a turning center 210' with multiple (e.g., six) modules 210*a*' may be used—and each module 210*a*' may respectively include the elements of a described turning center 210. Thus, the turning center 210' may functionally equate to a plurality of the turning centers 210.

After the turning operation 20, the machined penetrators 250 may be cleaned to remove residual oils and debris and sampled to ensure quality conformance. The machined penetrators 250 may be cleaned in various manners, whether currently known in the art or later developed. For example, the machined penetrators 250 may be washed in a soap and water mixture for ninety seconds, rinsed for thirty seconds, and dried for five minutes.

To ensure quality of the turning process 20, machined penetrators 250 may be gathered and examined at specific or varying intervals. In one embodiment, three consecutive machined penetrators 250 are inspected both visually and dimensionally to ensure quality. The visual inspection may examine, for example, the surface finish of the machined penetrators 250, uniformity of the machined penetrators 250, the shape of the machined penetrators 250, and any burrs. And the dimensional inspection may examine, for example, the overall length of the machined penetrators 250, the arrowhead geometries of the machined penetrators 250, and the weight of the machined penetrators 250. To maintain real time capability control, all quality control data may be entered into software.

Figure 10:
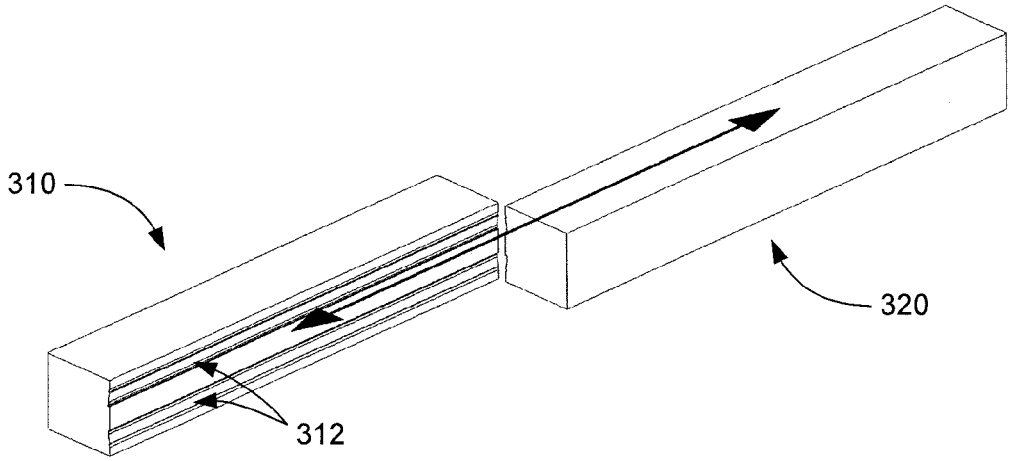
FIG. 10 shows a pair of dies for use in a roll forming process, according to an embodiment.
Figure 12:
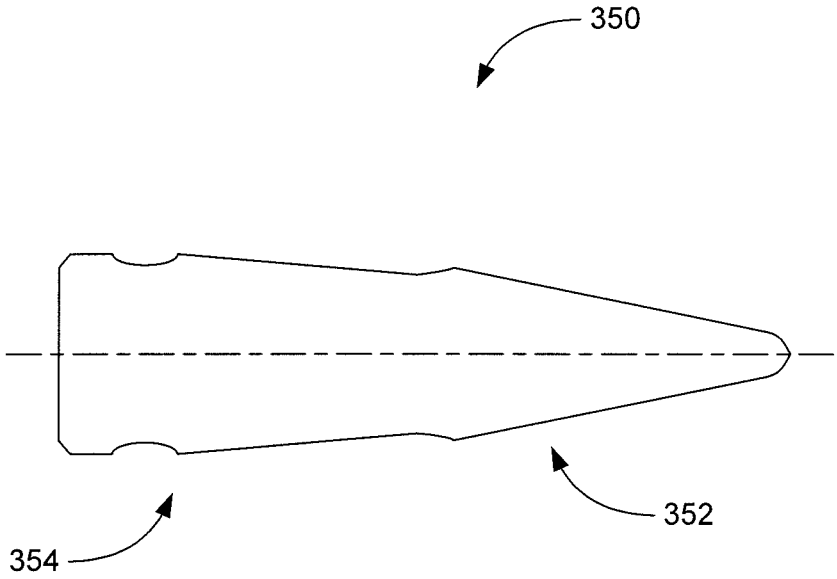
FIG. 12 shows an axial view of a cold headed, machined, and rolled penetrator, according to an embodiment.

The cleaned and validated machined penetrators 250 may be batched together and placed into feeder bowls mounted on roll forming machines for use in the roll forming process 30. At the roll forming process 30, the machined penetrators 250 satisfactorily turned in the machining process 20 are manipulated under pressure in a consistent rolling motion between two flat dies 310, 320 (FIG. 10) of a roll forming machine to create rolled penetrators 350 (FIG. 12) having a final dimensional profile.

The die 310 is positioned on a ram of the roll forming machine, and the die 320 is positioned in a die pocket of the roll forming machine. Accordingly, the die 310 moves parallel to the die 320 (in the directions indicated by the arrows in FIG. 10) during operation of the process 30, while the die 320 remains stationary.

Figure 11:
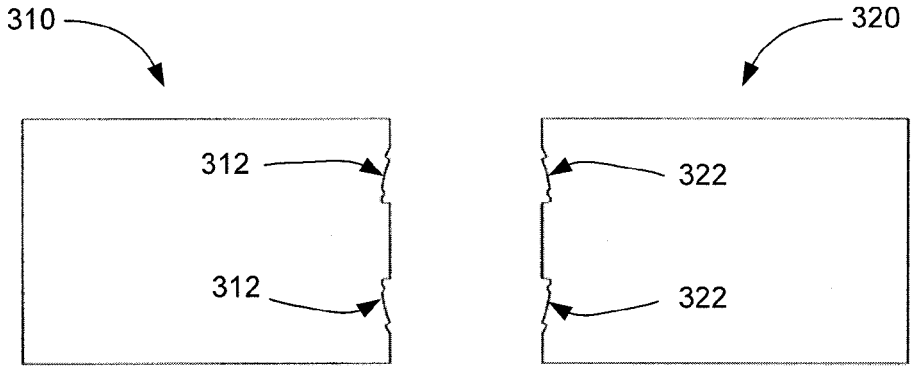
FIG. 11 shows an end view of the dies of FIG. 10.

Each die 310, 320 has a desired surface profile (or "forming element") 312, 322 (FIG. 11) machined in relief in the die faces, and each forming element 312, 322 may have a taper to allow the rolled profile of completed penetrators to blend seamlessly and concentrically with the turned profile created in the turning process 20. The profiles may blend, for example, at a point behind a ballistic nose 352 of each penetrator 350. As shown in FIG. 11, each die 310, 320 may have a pair of forming elements 312, 322, so that the dies 310, 320 can be inverted once one of the forming elements 312, 322 has reached its production life cycle.

In use, the machined penetrators 250 may be fed into the rolling machine by a vibratory hopper. As the machined penetrators 250 reach an end of the hopper, they are oriented to correspond to the dies 310, 320 and fed into the dies 310, 320. For example, the machined penetrators 250 may be gravity fed through a tube until coming to a rest upon a stop that is configured to allow the machined penetrators 250 to be horizontally fed into the dies 310, 320. As the ram reaches its rearward stroke, a pusher finger moves a machined penetrator 250 into the die 320. And as the ram begins to move forward, the die 310 acquires and feeds the machined penetrator 250 into the die 320. Pressure of the dies 310, 320 acting together ensures that the machined penetrator 250 enters the dies 310, 320 oriented in relation to the part centerline, and as the machined penetrator 250 moves into the working portions 312, 322 of the dies 310, 320, a roll (e.g., a clockwise roll) is initiated. As the machined penetrator 250 rolls through the dies 310, 320 along its centerline, the working portions 312, 322 in the die faces manipulate the machined penetrator 250 to create the desired surface profile and establish the final diametric dimensional attributes. The resultant action of the rolling manipulation ensures that the bases 354 of the rolled penetrators 350 are properly shaped and perpendicular in relation to the penetrator centerline. Cycle time of the roll forming process 30 may be, for example, two parts per second.

To ensure quality of the roll forming process 30, rolled penetrators 350 may be gathered and examined at specific or varying intervals. In one embodiment, three consecutive rolled penetrators 350 are inspected both visually and dimensionally to ensure quality. The visual inspection may examine, for example, the surface finish of the rolled penetrators 350, uniformity of the rolled penetrators 350, the shape of the rolled penetrators 350, and any burrs. And the dimensional inspection may examine, for example, the overall length of the rolled penetrators 350, the geometries of the rolled penetrators 350, and the weight of the rolled penetrators 350. To maintain real time capability control, all quality control data may be entered into software.

After the three processes 10, 20, 30, cleaned and validated penetrators 350 may undergo a heat treatment process 40 using equipment and methods now known or later developed.

Very notably, the combination of the three processes 10, 20, 30 may allow penetrators to be produced at higher rates and lower costs compared to prior art manufacturing methods, and using relatively inexpensive machinery and tooling. And again, while the turning step 20 has been described above as occurring before the roll forming step 30, the order of the machining and roll forming steps 20, 30 may generally be altered at the discretion of the manufacturer. Because the turning process 20 and the roll forming process 30 may each be responsible for distinct portions of the final geometry, the order of steps 20, 30 typically is not critical.

Many different arrangements of the various components depicted, as well as components not shown, are possible without departing from the spirit and scope of the present invention. Embodiments of the present invention have been described with the intent to be illustrative rather than restrictive, and alternative embodiments that do not depart from the invention's scope will become apparent to those skilled in the art. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. Not all steps listed in the various figures need be carried out in the specific order described.

The invention claimed is:

1. A method of manufacturing a plurality of penetrators from a material besides lead, the method comprising: providing a plurality of blanks to at least one turning center; each blank having a generally cylindrical body portion and a nose portion extending, angularly from the cylindrical body portion; the at least one turning center having a spindle, a clamping device, and a cutting tool; using the at least one turning center to turn a portion of the blanks to create arrowhead geometry in the blanks; and roll forming the blanks to create base geometry in the blanks; wherein the base geometry blends with the arrowhead geometry.

2. The method of claim 1, further comprising heat treating the arrowhead geometry and the base geometry.

3. The method of claim 1, wherein the arrowhead geometry is created before the base geometry is created.

4. The method of claim 1, wherein the base geometry is created before the arrowhead geometry is created.

* * * * *